US006921274B2

(12) United States Patent
Yu

(10) Patent No.: US 6,921,274 B2
(45) Date of Patent: Jul. 26, 2005

(54) ELECTRICAL CONNECTOR WITH IMPROVED CONTACT

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/910,073

(22) Filed: Aug. 2, 2004

(65) Prior Publication Data

US 2005/0026487 A1 Feb. 3, 2005

(30) Foreign Application Priority Data

Aug. 1, 2003 (TW) ..... 92214061 U

(51) Int. Cl.[7] ..... H01R 13/62
(52) U.S. Cl. ..... 439/260; 439/495
(58) Field of Search ..... 439/260, 495

(56) References Cited

U.S. PATENT DOCUMENTS 5,695,360 A 12/1997 Seto et al.
5,842,883 A 12/1998 Igarashi et al.
5,895,287 A 4/1999 Seto et al.
6,099,346 A * 8/2000 Hashiguchi et al. ..... 439/495
6,224,418 B1 * 5/2001 Miura et al. ..... 439/495
6,352,442 B1 * 3/2002 Kudo ..... 439/260
6,471,541 B2 * 10/2002 Kunishi et al. ..... 439/495
6,755,682 B2 * 6/2004 Kunishi et al. ..... 439/495
6,767,233 B2 * 7/2004 Tsunematsu ..... 439/260

* cited by examiner

*Primary Examiner*—Gary Paumen
*Assistant Examiner*—James R. Harvey
(74) *Attorney, Agent, or Firm*—Wei Te Chung

(57) ABSTRACT

An electrical connector for FPC comprises a dielectric housing, a plurality of contacts received in the housing, and an actuation portion movably mounted on the housing. The housing defines a longitudinal receiving portion, and the receiving portion has a plurality of protrusions. The contact is formed with a first arm, a second arm and a foot, and an end of the first arm defines a head. The protrusions are formed adjacent to the head, and the profile of the head has a common axis with the profiles of its adjacent protrusions. The head together with the protrusions serves as a common shaft for the actuation portion.

15 Claims, 6 Drawing Sheets

ELECTRICAL CONNECTOR WITH IMPROVED CONTACT

BACKGROUND OF THE INVENTION

1. Field of the Invention

The present invention relates to an electrical connector, and particularly, to an electrical connector for connecting an FPC(Flexible Printed Circuit) to a PCB(printed circuit board).

2. Description of Related Art

A conventional electrical connector for connecting a flexible printed circuit typically includes a dielectric housing having a slot for receiving a connecting end or an edge of the FPC. An actuation portion is pivotally assembled on the housing for pressing the FPC. A plurality of pairs of terminals are mounted in the housing and arranged at regular spaced intervals longitudinally along the slot. The actuation portion can rotate around the housing from a closed position to an open position, in one position, where the actuation portion is substantially parallel with the housing, the FPC is connected with the electrical connector; in the other position, where the actuation portion is substantially perpendicular to the housing, the FPC is disconnected with the electrical connector. Such an electrical connector is disclosed in U.S. Pat. Nos. 5,842,883, 5,695,360, 5,895,287.

As shown in FIG. 8, a contact 6 of a conventional electrical connector 9 for connecting an FPC comprises an orientation portion 62 fastened in a housing 8, a pressing portion 64 for connecting an edge of the FPC, and a foot 66 for being soldered onto a PCB(not shown). An actuation portion 7 pivotally mounted on the housing 8 can rotate around the retention portion 62 of the contact 6. However, when inserting the FPC into the electrical connector 9 and rotating the actuation portion 7, a repeated movement between the actuation portion 7 and the retention portion 62 tends to generate a force along a direction of a separation of the contact 6 from the housing 8, which leads to an unreliable connection between the contact 6 and the PCB, and even a deformation of the contact 6 or the separation of the contact 6 from the housing 8.

Therefore, an improved electrical connector for connecting an FPC is required to overcome the aforesaid disadvantages of the prior art.

SUMMERY OF THE INVENTION

Accordingly, an object of the present invention is to provide an electrical connector with improved contacts for connecting an FPC, which can effectively prevent a contact thereof from separating from a housing thereof and enables a reliable connection between the contact and the FPC.

To achieve the above-mentioned object, an electrical connector with improved contacts is provided by the present invention. In a preferred embodiment, the electrical connector includes a dielectric housing, an actuation portion pivotally assembled on the housing, and a plurality of contacts received in the housing. The dielectric housing has an elongated receiving portion, a front surface of the receiving portion defines a plurality of passageways arranged at regular spaced intervals longitudinally, and a protrusion is formed between every two passageways.

The contact comprises a first arm, a second arm formed opposed to the first arm, a middle portion formed between the first arm and the second arm, a third arm formed opposite to the middle portion and a foot for being soldered onto a PCB. An end of the first arm defines a head whose profile has the same axis as the one of the protrusion. The head together with its adjacent protrusion serves as a common shaft for the actuation portion. When the electrical connector is closed, a distance from the profile of the protrusion to the PCB is greater than the one from the profile of the head to the PCB. The second arm, at its distal end opposed to the head, defines an urging portion for connecting the FPC. The third arm defines two stoppers at two distal ends thereof. The foot is formed opposed to the stopper near the second arm.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in details.

Figure 1:
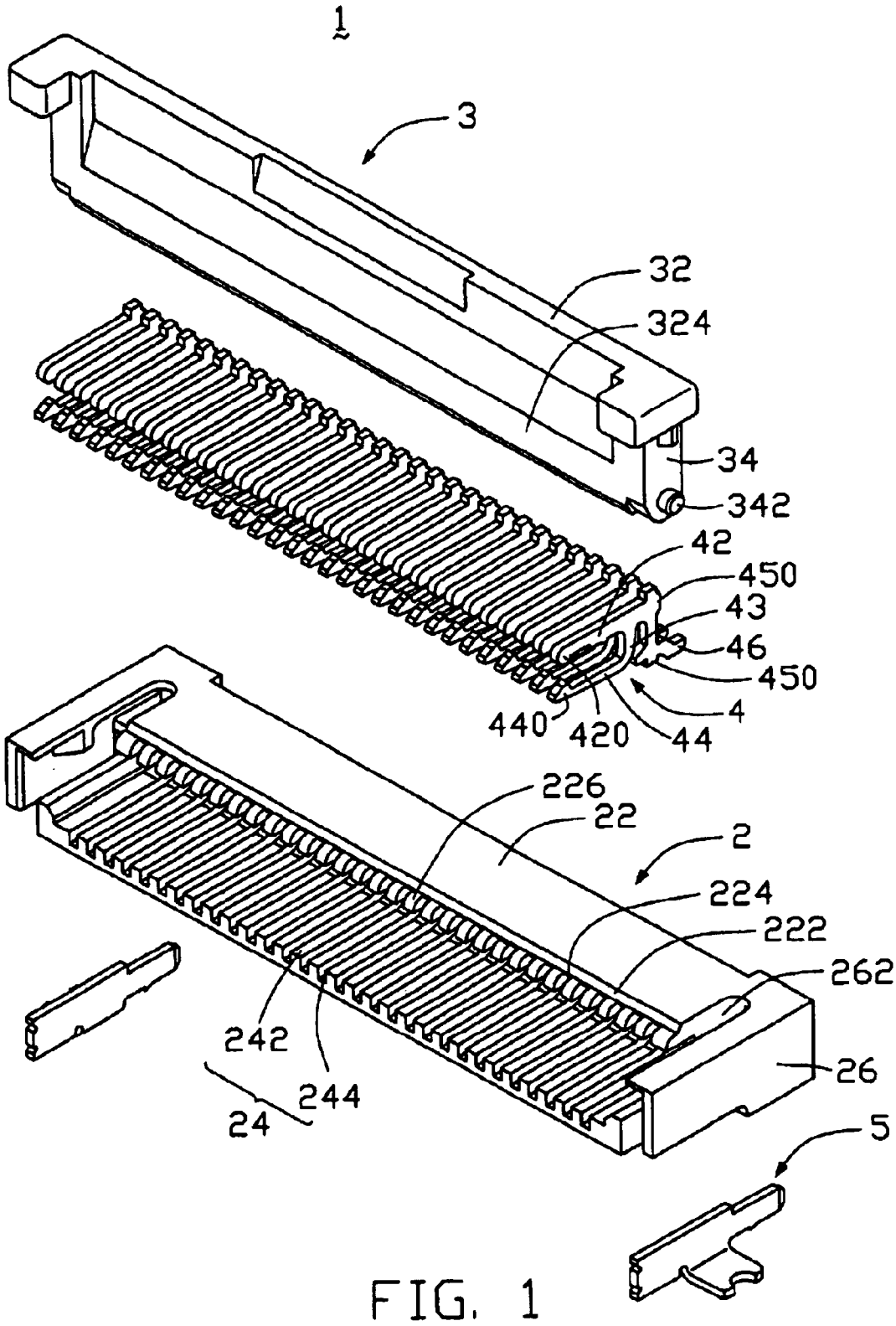
FIG. 1 is an exploded isometric view of an electrical connector with a preferred embodiment of the present invention.
Figure 2:
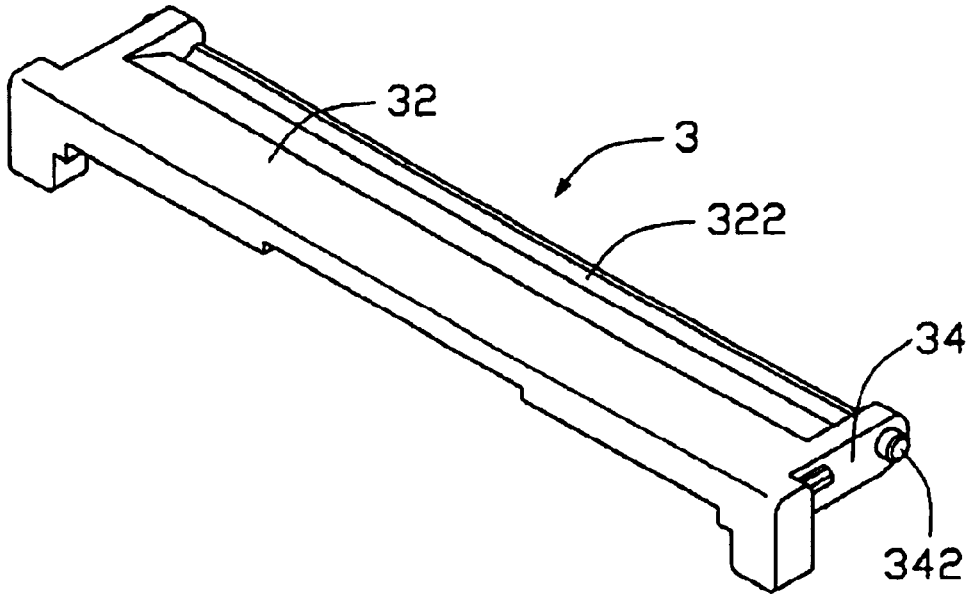
FIG. 2 is an isometric view of an actuation portion of the electrical connector.
Figure 3:
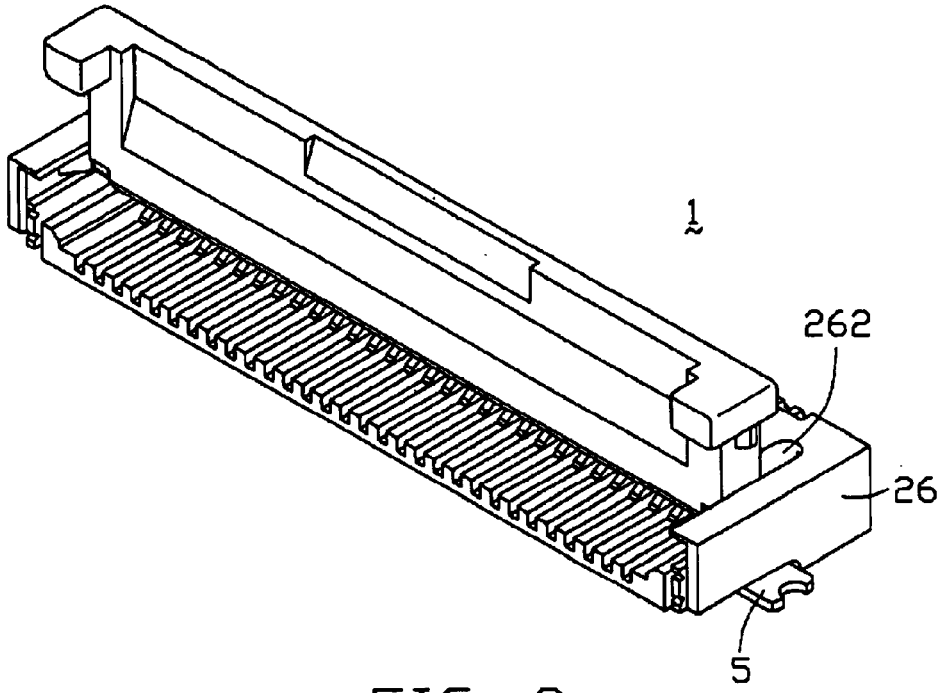
FIG. 3 is an isometric view of the electrical connector when opening the actuation portion.
Figure 4:
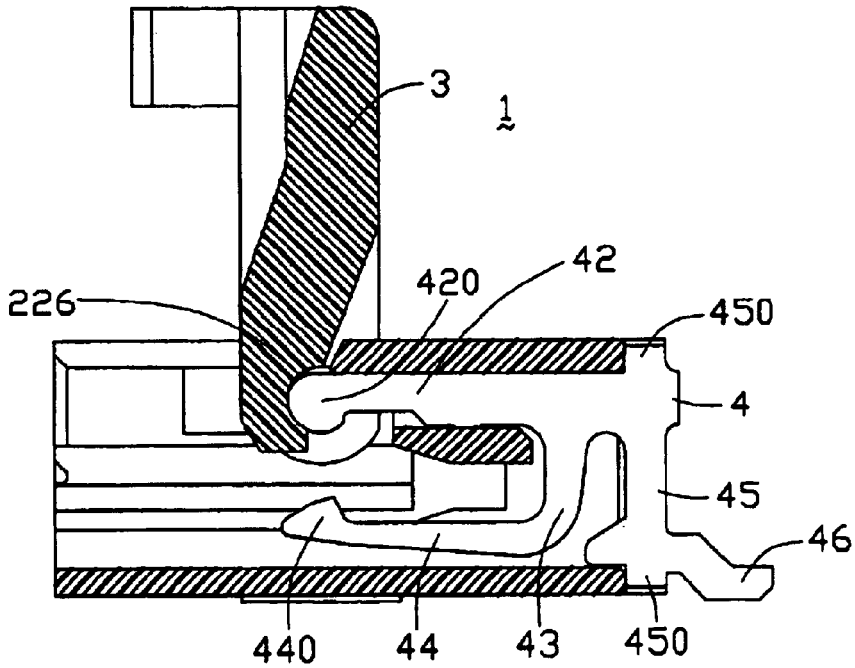
FIG. 4 is a cross-sectional view of the electrical connector when opening the actuation portion.
Figure 7:
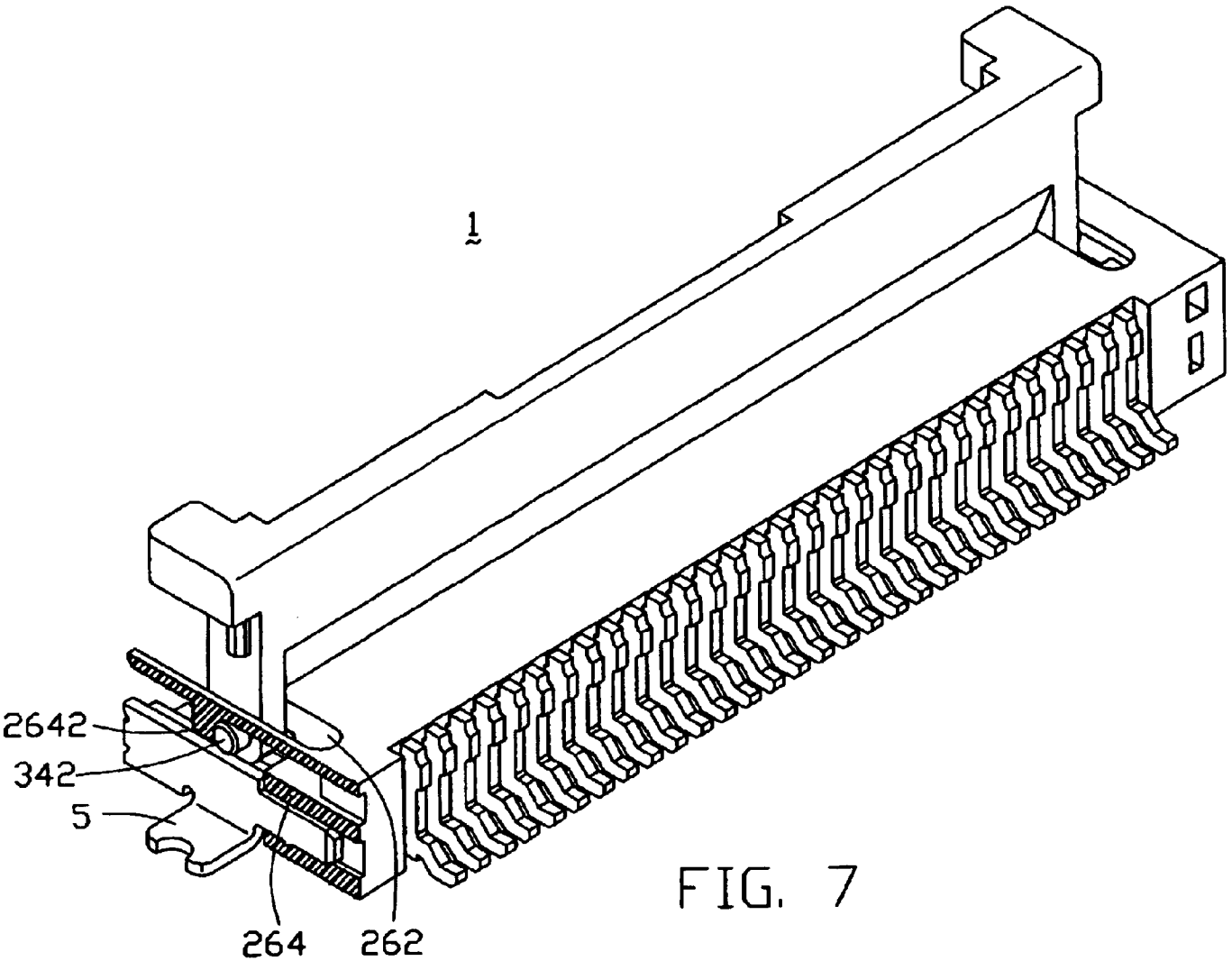
FIG. 7 is an isometric view of the electrical connector partly cut away.
Figure 8:
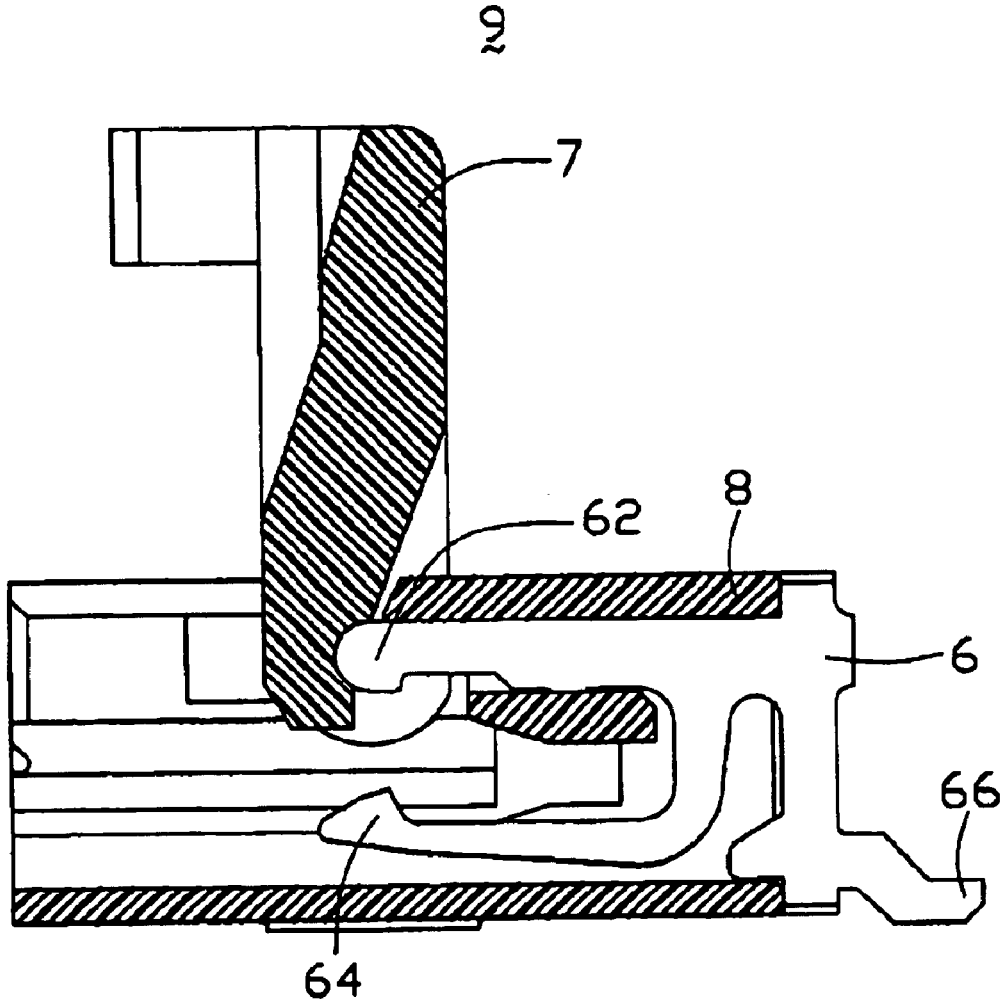
FIG. 8 (PRIOR ART)
FIG. 8 is an isometric view of a conventional FPC electrical connector.

Referring to FIG. 1 and FIG. 7, an electrical connector 1 in accordance with the present invention includes a dielectric housing 2, an actuation portion 3 rotatablely mounted on the housing 2, a plurality of contacts 4 received in the housing 2, and two metal ears 5 inlaid in the housing 2. The housing 2 comprises an elongated receiving portion 22, a holding portion 24 perpendicularly extending from the receiving portion 22. Two retention arms 26 perpendicularly extend from the both ends of the receiving portion 22. A front surface 222 of the receiving portion 22 defines a plurality of passageways 224 arranged at regular spaced intervals longitudinally. Between every two adjacent passageways 224, a protrusion 226 is formed. An upper surface 242 of the holding portion 24 defines a plurality of grooves 244 which are parallel with each other in accordance with the passageways 224. The retention arms 26 comprise a pair of receiving recesses 262 formed in both ends of the housing 2 and two guideways 264 formed with blocks 2642 thereof defined in an outside wall of the receiving recesses 262.

Referring to FIGS. 1, 2, 4 and 7, the actuation portion 3 comprises an elongated base 32 and two side walls 34 respectively formed at each end of the base 32. One longitudinal side of the base 32 defines a through recess 322 for mating with the protrusions 226, the other longitudinal side of the base 32 defines a pressing portion 324 for pressing an FPC. The side walls 34 accommodated in the receiving recesses 262 of the housing 2 has two pivots 342 substantially perpendicularly extending from each end thereof.

Referring to FIGS. 1, 2, 4 and 6, a contact 4 comprises a first arm 42, and a second arm 44 formed opposed to the first arm 42. An end of the first arm 42 defines a head 420 whose profile has the same axis as the one of the protrusion 226, the head 420 together with its adjacent protrusions 226 serves as a common shaft for the actuation portion 3. When the electrical connector 1 is closed, a distance from the profile of the protrusion 226 to the PCB is greater than the one from the profile of the head 420 to the PCB. The second arm 44, at its distal end opposed to the head 420, defines an urging portion 440 for connecting the FPC. A middle portion 43 is connected the first arm 42 and the second arm 44. A third arm 45 formed opposite to the middle portion 43 defines two stoppers 450 at two distal ends thereof. A foot 46 for being soldered onto the PCB is formed opposed to the stopper 450 near the second arm 44.

Referring to FIG. 1, a metal ear 5 for being soldered onto the PCB is inlaid into each side of the housing 2, which can strengthen the connection of the electrical connector 1 and the PCB.

Referring to FIGS. 1, 3, 4 and 7, an assembly of the electrical connector 1 includes several steps as following: First of all, it is to install the contact 4 into the housing 2; Secondly, it is to insert the pivots 342 along the guideways 264 and then abut them against the corresponding blocks 2642 so that the actuation portion 3 is orientated on the housing 2.

Figure 5:
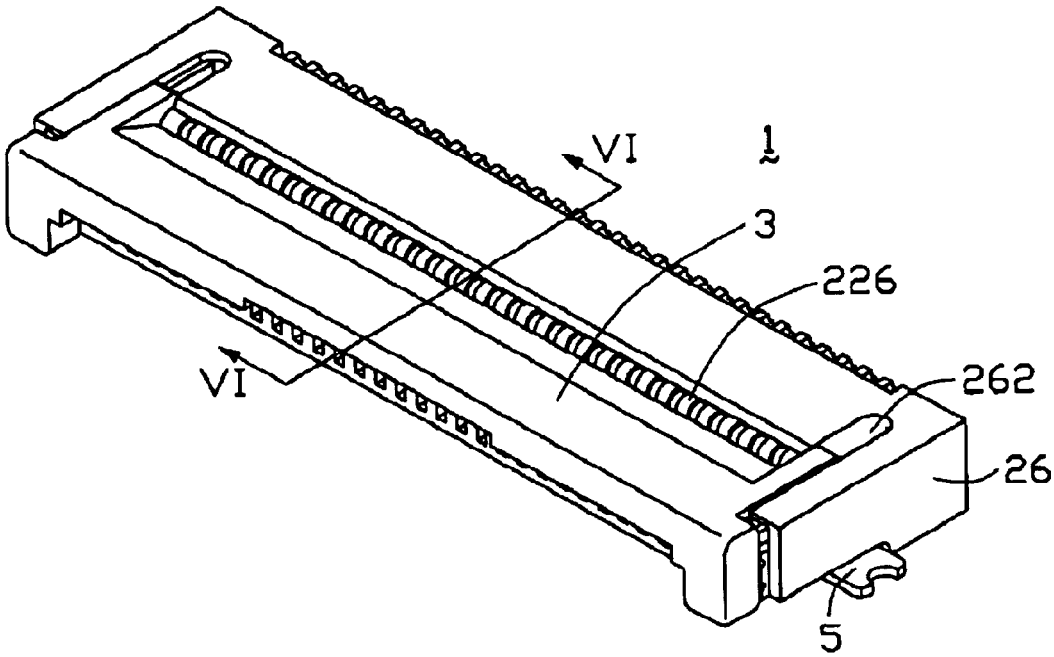
FIG. 5 is an isometric view of the electrical connector when closing the actuation portion.
Figure 6:
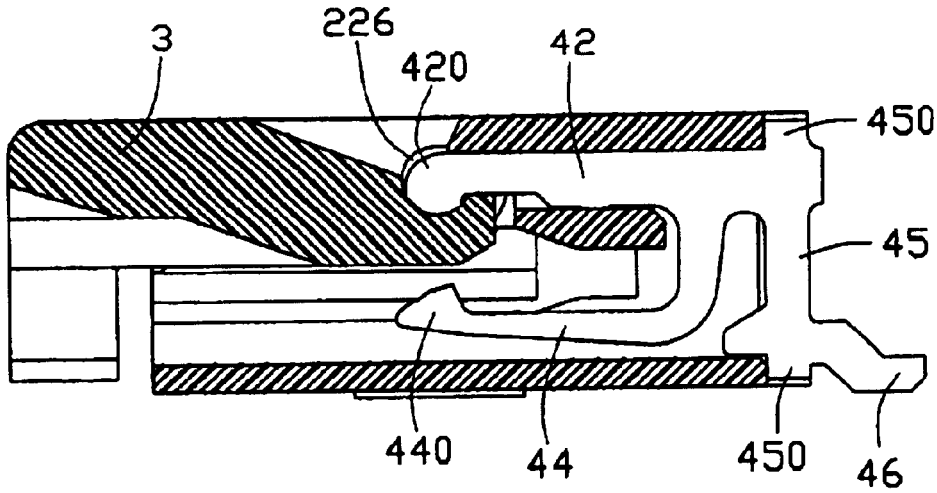
FIG. 6 is a cross-sectional view taken along line VI—VI of FIG. 5.

Referring to FIGS. 1, 5 and 6, when using the electrical connector 1, it is first to insert the FPC between the first arm 42 and the second arm 44 of the contact 4, and then to rotate the actuation portion 3. A relatively big pressure for pressing the FPC is not necessary until the actuation portion is at almost a half position between an open position and a close position.

When the actuation portion 3 is rotated from the open position to the half position, the actuation portion 3 is rotated around the protrusions 226 of the receiving portion 22, and what's more, there is no contact between the actuation portion 3 and the head 420 in said process. Therefore, there is no forces, along a direction of an separation of the contact 4 and the housing 2, that happen to the contact 4.

When the actuation portion 3 is rotated from the half position to the close position, a sufficient pressure for pressing the FPC is needed, so the actuation portion changes to rotate around the head 420 of the contact 4 because the rigid metallic contact 4 is strong enough to provide the sufficient pressure. A friction and a normal force between the contact 4 and actuation portion 3 are not along the direction of the separation of the contact 4 and the housing 2. Consequently, the contact 4 won't separate from the housing 2, and a reliable connection between the electrical connector 1 and the FPC is gained.

while a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting a flexible printed circuit to a printed circuit board, comprising:

a dielectric housing having a longitudinal receiving portion, the receiving portion defining a plurality of passageways and protrusions;

a plurality of contacts received in the housing, the contact defining a first arm, a second arm opposed to the first arm and a foot, the first arm defining a head at its distal end;

an actuation portion movably mounted on the housing, the actuation portion defining an elongated base and a recess for mating with the head and the respective protrusion;

wherein the protrusion is formed adjacent to the head, a profile of the head has a common axis with a profile of the protrusion, and the head and the protrusion serve as a common shaft for the actuation portion to pivot about the common axis.

2. The electrical connector as claimed in claim 1, wherein a distance from the profile of the protrusion to the printed circuit board is greater than a distance from the profile of the head to the printed circuit board.

3. The electrical connector as claimed in claim 1, wherein the contact comprises a middle portion connecting the first arm and the second arm.

4. The electrical connector as claimed in claim 3, wherein the contact comprises a third arm having at least one stopper formed opposite to the middle portion.

5. The electrical connector as claimed in claim 4, wherein the head and the protrusion are formed into round shape.

6. The electrical connector as claimed in claim 5, wherein the housing defines a holding portion and a pair of retention arms extending from both ends of the receiving portion.

7. The electrical connector as claimed in claim 6, wherein the actuation portion defines two side walls respectively formed at each end of the base.

8. The electrical connector as claimed in claim 7, wherein the retention arm defines a pair of receiving recesses in both ends of the housing.

9. The electrical connector as claimed in claim 8, wherein the receiving recess defines an outside wall, and at least two guideways with blocks are formed in both ends of the housing.

10. The electrical connector as claimed in claim 9, wherein the actuation portion defines two pivots abutting against the blocks of the guideways.

11. The electrical connector as claimed in claim 10, wherein the pressing portion defines an upper portion, the upper surface defining a plurality of grooves corresponding to the passageways.

12. The electrical connector as claimed in claim 11, wherein the grooves are parallel with each other.

13. The electrical connector as claimed in claim 12, wherein the actuation portion has a pressing portion for pressing the flexible printed circuit.

14. An electrical connector assembly comprising:

an insulative housing defining a receiving slot therein;

a plurality of contacts disposed by upper and lower sides of the receiving slot, said contacts defining abutment ends on the upper side;

a plurality of abutment protrusions formed on a front face of the housing adjacent to the neighboring abutment ends in an alternating manner;

an actuator pivotally mounted to the housing; wherein the actuator defines an engagement edge which initially only engages the protrusions without engagement with the abutment ends at an initial stage when said actuator is rotated from an open position to a closed position, but successively engages the abutment ends at a final stage when said actuator is rotated from the open position to the closed position.

15. The assembly as described in claim 14, wherein said engagement edge also engages the protrusions at the final stage.

* * * * *